US011084141B2

(12) United States Patent
Xu et al.

(10) Patent No.: US 11,084,141 B2
(45) Date of Patent: Aug. 10, 2021

(54) WHEEL BACK CAVITY GROOVE PROCESSING EQUIPMENT

(71) Applicant: CITIC Dicastal CO., LTD, Qinhuangdao (CN)

(72) Inventors: Zuo Xu, Qinhuangdao (CN); Bowen Xue, Qinhuangdao (CN); Guorui Wu, Qinhuangdao (CN); Xuesong Wang, Qinhuangdao (CN); Jiandong Guo, Qinhuangdao (CN)

(73) Assignee: CITIC DICASTAL CO., LTD, Hebei (CN)

( * ) Notice: Subject to any disclaimer, the term of this patent is extended or adjusted under 35 U.S.C. 154(b) by 369 days.

(21) Appl. No.: 15/937,103

(22) Filed: Mar. 27, 2018

(65) Prior Publication Data

US 2019/0193234 A1 Jun. 27, 2019

(30) Foreign Application Priority Data

Dec. 22, 2017 (CN) ..... 2017 1 1398808

(51) Int. Cl.

| | |
|---|---|
| ***B24B 21/06*** | (2006.01) |
| ***B24B 29/00*** | (2006.01) |
| ***B24B 19/02*** | (2006.01) |
| ***B24B 21/00*** | (2006.01) |
| ***B24B 5/44*** | (2006.01) |
| ***B24B 27/00*** | (2006.01) |
| ***B24B 9/04*** | (2006.01) |

(52) U.S. Cl.

CPC ..... *B24B 21/06* (2013.01); *B24B 5/44* (2013.01); *B24B 9/04* (2013.01); *B24B 19/02* (2013.01); *B24B 21/008* (2013.01); *B24B 27/0076* (2013.01); *B24B 29/005* (2013.01)

(58) Field of Classification Search

CPC ..... B24B 21/06; B24B 21/006; B24B 21/02; B24B 21/12; B24B 21/008; B24B 21/16; B24B 9/07; B24B 19/02; B24B 29/005; B24B 29/04; B24B 5/44; B24B 5/01; B24B 5/06; B24B 27/0076

USPC ... 451/65, 66, 180, 254, 307, 209, 296, 246, 451/249, 258

See application file for complete search history.

(56) References Cited

U.S. PATENT DOCUMENTS 4,527,300 A * 7/1985 Kunde ..... B24B 29/04 15/88.2

5,600,861 A * 2/1997 Saito ..... A46B 13/008 15/21.1

(Continued)

*Primary Examiner* — Eileen P Morgan
*Assistant Examiner* — Marcel T Dion
(74) *Attorney, Agent, or Firm* — Calfee, Halter & Griswold LLP

(57) ABSTRACT

Wheel back cavity groove processing equipment is disclosed in the present application, which includes a lower lifting system, a central brush system, groove brush systems, a synchronous clamping and rotating system, a left brush system, a right brush system, an upper lifting system and the like. The wheel back cavity groove processing equipment not only may be used for removing burrs from wheel back cavity grooves, but also may be used for removing burrs from bolt holes, a center hole, spoke edges and transverse corners, and simultaneously has the characteristics of high automation degree, high removal efficiency, advanced process, strong generality, and high safety and stability.

1 Claim, 3 Drawing Sheets

(56) References Cited

U.S. PATENT DOCUMENTS

| | | | | |
|---|---|---|---|---|
| 7,063,607 | B2 * | 6/2006 | Sim | A63B 45/00 451/178 |
| 9,782,866 | B1 * | 10/2017 | Xue | B24B 9/04 |
| 2007/0037497 | A1 * | 2/2007 | Tanaka | B24B 21/02 451/312 |
| 2007/0042678 | A1 * | 2/2007 | Tanaka | B24B 5/44 451/5 |
| 2016/0184958 | A1 * | 6/2016 | Xue | B24B 29/005 451/59 |
| 2016/0279755 | A1 * | 9/2016 | Spaile | B24B 5/44 |
| 2016/0353873 | A1 * | 12/2016 | Xue | A46B 13/02 |
| 2016/0354891 | A1 * | 12/2016 | Xue | B24B 47/12 |
| 2017/0209976 | A1 * | 7/2017 | Xue | B24B 9/04 |

* cited by examiner

WHEEL BACK CAVITY GROOVE PROCESSING EQUIPMENT

CROSS-REFERENCE TO RELATED APPLICATIONS

This application claims priority to Chinese Patent Application No. 201711398808.X, filed on Dec. 22, 2017, which is hereby incorporated by reference in its entirety.

TECHNICAL FIELD

The present application relates to a burr removing equipment, and specifically, to a wheel back cavity burr removing equipment.

BACKGROUND ART

In the production process of aluminum alloy wheels, a wheel having grooves at the edge of a back cavity is often encountered, burrs may be produced in the machining process of the grooves, these burrs at the special part are very difficult to process, and currently, there is no mature equipment available to effectively process the burrs at this part.

SUMMARY OF THE INVENTION

The present application is aimed at providing wheel back cavity groove processing equipment, which not only may be used for removing burrs from wheel back cavity grooves, but also may be used for removing burrs from bolt holes, a center hole, spoke edges and transverse corners.

In order to fulfill the above aim, the technical solution of the present application is: wheel back cavity groove processing equipment, includes a frame, a first cylinder, lower guide posts, a rotary joint, a spline shaft, a first servo motor, a first belt pulley, a first synchronous belt, a second belt pulley, a lower fixed plate, lower guide sleeves, a spline sleeve, a first bearing seat, a lower lifting plate, first guide rails, first racks, second servo motors, first servo electric cylinders, turnover plates, second bearing seats, first shafts, small grinding heads, a spring, a sliding sleeve, a conical grinding head, a third belt pulley, a first annular belt brush, a first fixed rack, a third servo motor, a fourth belt pulley, a second servo electric cylinder, a second guide rail, a first sliding plate, a third guide rail, an upper lifting plate, upper guide posts, upper guide sleeves, second cylinders, a second sliding plate, a fourth guide rail, a third servo electric cylinder, a fourth servo motor, a fifth belt pulley, a second synchronous belt, a fixed second rack, a sixth belt pulley, a seventh belt pulley, a third fixed rack, an eighth belt pulley, a second annular belt brush, sliding racks, a deflector rod, a first gear, a swivel, third cylinders, an upper fixed plate, a second gear, second racks, a fifth guide rail, a left sliding plate, left shafts, left bearing seats, V-shaped rollers, a fourth servo electric cylinder, right shafts, right bearing seats, a right sliding plate, a fourth cylinder, a fifth servo motor and a fifth servo electric cylinder.

A lower lifting system includes: the two third cylinders and the four lower guide sleeves are all fixed on the lower fixed plate, and the four lower guide posts matched with the lower guide sleeves are fixed below the lower lifting plate; and the output ends of the third cylinders are articulated with the lower part of the lower lifting plate.

A central brush system includes: the first bearing seat is fixed below the lower lifting plate; the spline sleeve is mounted inside the first bearing seat via a bearing; the spline shaft is matched with the spline sleeve; the first cylinder is fixed at the bottom of the frame, and the rotary joint is fixed at the output end of the first cylinder; the upper part of the rotary joint is connected with the lower part of the spline shaft; the first belt pulley is fixed below the spline sleeve; the first servo motor is fixed below the lower lifting plate via a transition flange; the second belt pulley is fixed at the output end of the first servo motor; the first belt pulley is connected with the second belt pulley via the synchronous belt; the spline shaft is matched with the first bearing seat; the deflector rod is fixed above the spline shaft; the spring is mounted inside the sliding sleeve, and reaches the top of the spline shaft; and the conical grinding head is fixed at the top of the sliding sleeve.

A groove brush system includes; the sliding rack is mounted above the lower lifting plate via the first guide rail; the first rack is fixed on the sliding rack, and engaged with the first gear; the upper part of the first gear is provided with a groove matched with the deflector rod, and the lower part is mounted above the lower lifting plate via the swivel; the second bearing seat is mounted above the turnover plate; the first shaft is mounted inside the second bearing seat via a bearing; the small grinding head is fixed above the first shaft; the second servo motor is fixed below the turnover plate, and the output end thereof is connected with the lower part of the first shaft; the lower part of the turnover plate is articulated with the upper part of the sliding rack; the lower part of the first servo electric cylinder is articulated with the upper part of the sliding rack, and the output end thereof is articulated with the turnover plate; this equipment includes a plurality of sets of groove brush systems, which are uniformly distributed around the center line of the first gear and correspond to bolt holes on the wheel in number.

A synchronous clamping and rotating system includes: the second gear is fixed above the upper fixed plate; the left sliding plate is mounted above the upper fixed plate via the fifth guide rail; the second rack is fixed below the left sliding plate, and the two left bearing seats are fixed above the left sliding plate; the two left shafts are mounted inside the left bearing seats via bearings; a V-shaped roller is respectively mounted above the two left shafts; the right sliding plate is mounted above the upper fixed plate via the fifth guide rail; a second rack is fixed below the right sliding plate, and the two right bearing seats are fixed above the right sliding plate; the second rack below the left sliding plate and the second rack below the right sliding plate are simultaneously engaged with the second gear; the two right shafts are mounted inside the right bearing seats via bearings; a V-shaped roller is respectively mounted above the two right shafts; the fifth servo motor is fixed below the right sliding plate, and the output end thereof is connected with the lower end of one right shaft; the fourth cylinder is fixed on the right of the frame, and the output end thereof is connected with the right sliding plate.

A left brush system includes: the third belt pulley is mounted below the first fixed rack; the fourth belt pulley is mounted above the first fixed rack; the third servo motor is mounted on the side of the first fixed rack, and the output end thereof is connected with a shaft of the fourth belt pulley; the first annular belt brush is simultaneously connected with the third belt pulley and the fourth belt pulley; the top of the first fixed rack is mounted below the first sliding plate via the second guide rail; the first sliding plate is mounted below the upper lifting plate via the third guide rail; the second servo electric cylinder is fixed on the left side of the upper lifting plate, and the output end thereof is connected with the first sliding plate; the fourth servo electric cylinder is fixed at one end of the first sliding plate, and the output end thereof is connected with the first fixed rack.

A right brush system includes: the eight belt pulley is mounted below the third fixed rack; the third fixed rack is fixed below the second fixed rack; the sixth belt pulley is mounted on the right side of the seventh belt pulley, and mounted below the second fixed rack; the fourth servo motor is fixed above a middle division plate of the second fixed rack, and the fifth belt pulley is fixed at the output end of the fourth servo motor; the fifth belt pulley is connected with the sixth belt pulley via the second synchronous belt; the seventh belt pulley is connected with the eight belt pulley via the second annular belt brush; the top of the second fixed rack is mounted below the second sliding plate via the fourth guide rail; the top of the second sliding plate is mounted below the upper lifting plate via the third guide rail; the third servo electric cylinder is fixed on the right side of the upper lifting plate, and the output end thereof is connected with the second sliding plate; the fifth servo electric cylinder is fixed at one end of the second sliding plate, and the output end thereof is connected with the second fixed rack.

An upper lifting system includes: the four upper guide posts are fixed above the upper lifting plate; the four upper guide sleeves matched with the upper guide posts are fixed at the top of the frame; the two second cylinders are also fixed at the top of the frame, and the output ends thereof are articulated with the upper part of the upper lifting plate.

In the working process, the fourth cylinder drives the four V-shaped rollers via the second gear and the second racks to synchronously clamp a wheel; the first servo motor drives the spline sleeve and the spline shaft via the first belt pulley, the second belt pulley and the synchronous belt to rotate; the spline shaft drives the conical grinding head via the sliding sleeve to rotate; the spring keeps the conical grinding head in a floating state; the second servo motors drive the small grinding heads via the first shafts to rotate; the first servo electric cylinders adjust the angles of the small grinding heads in the groove brush systems via the turnover plates, so that the small grinding heads are all in a vertical state; the first cylinder drives the deflector rod on the spline shaft via the rotary joint to decline, so that the deflector rod is matched with the groove above the first gear; the first servo motor drives the spline shaft via the first synchronous belt to rotate again, and simultaneously drives the first gear to rotate; the first gear can adjust the position of each small grinding head via the first rack, so that the axis of the small grinding head is on the pitch circle of each bolt hole of the wheel; the fifth servo motor drives the clamped wheel to rotate, so that the axis of each bolt hole of the wheel is just coaxial with the axis of each small grinding head; the third cylinders drive the small grinding heads and the conical grinding head via the lower guide posts to ascend, to remove burrs thereon when they contact the bolt holes and the center hole of the wheel; after removal, the position of each small grinding head is continuously adjusted via the first gear and the first rack to the edge of the wheel back cavity, and at the same time, the angle of each small grinding head is adjusted via the first servo electric cylinder to contact a groove at the edge of the wheel back cavity; the fifth servo motor drives the wheel via the right shafts to rotate, and burrs at the grooves can be removed; the third servo motor drives the fourth belt pulley to rotate, and the first annular belt brush can rotate via the third belt pulley; the second servo electric cylinder can drive the first annular belt brush via the third guide rail to move left and right; the fourth servo motor can drive the first annular belt brush via the second guide rail to move front and back; the second cylinders can drive the first annular belt brush via the upper guide posts to move up and down; burrs at the transverse corners of spokes can be removed via rotation of the first annular belt brush and movement thereof in three directions; the fourth servo motor drives the seventh belt pulley via the fifth belt pulley, the sixth belt pulley and the second synchronous belt to rotate, and can drive the second annular belt brush via the eight belt pulley to rotate; the third servo electric cylinder can drive the second annular belt brush via the third guide rail to move left and right; the fifth servo electric cylinder can drive the second annular belt brush via the fourth guide rail to move front and back; the second cylinders can drive the second annular belt brush via the upper guide posts to move up and down; and burrs at the edges of the spokes can be removed via rotation of the second annular belt brush and movement thereof in three directions.

The present application not only may be used for removing burrs from wheel back cavity grooves, but also may be used for removing burrs from bolt holes, a center hole, spoke edges and transverse corners, and simultaneously has the characteristics of high automation degree, high removal efficiency, advanced process, strong generality, and high safety and stability.

Figure 1:
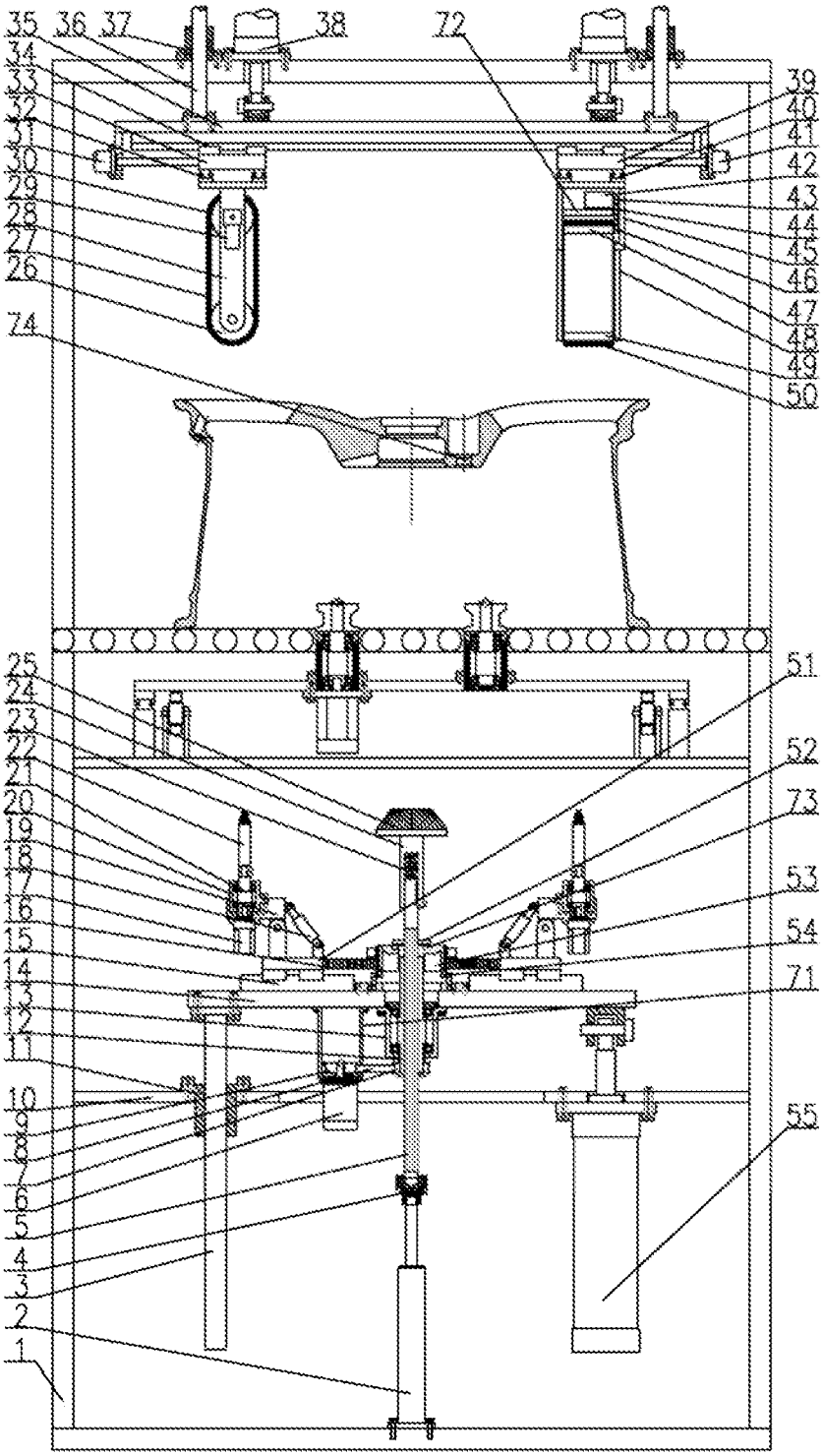
FIG. 1 is a front view of wheel back cavity groove processing equipment of the present application.
Figure 2:
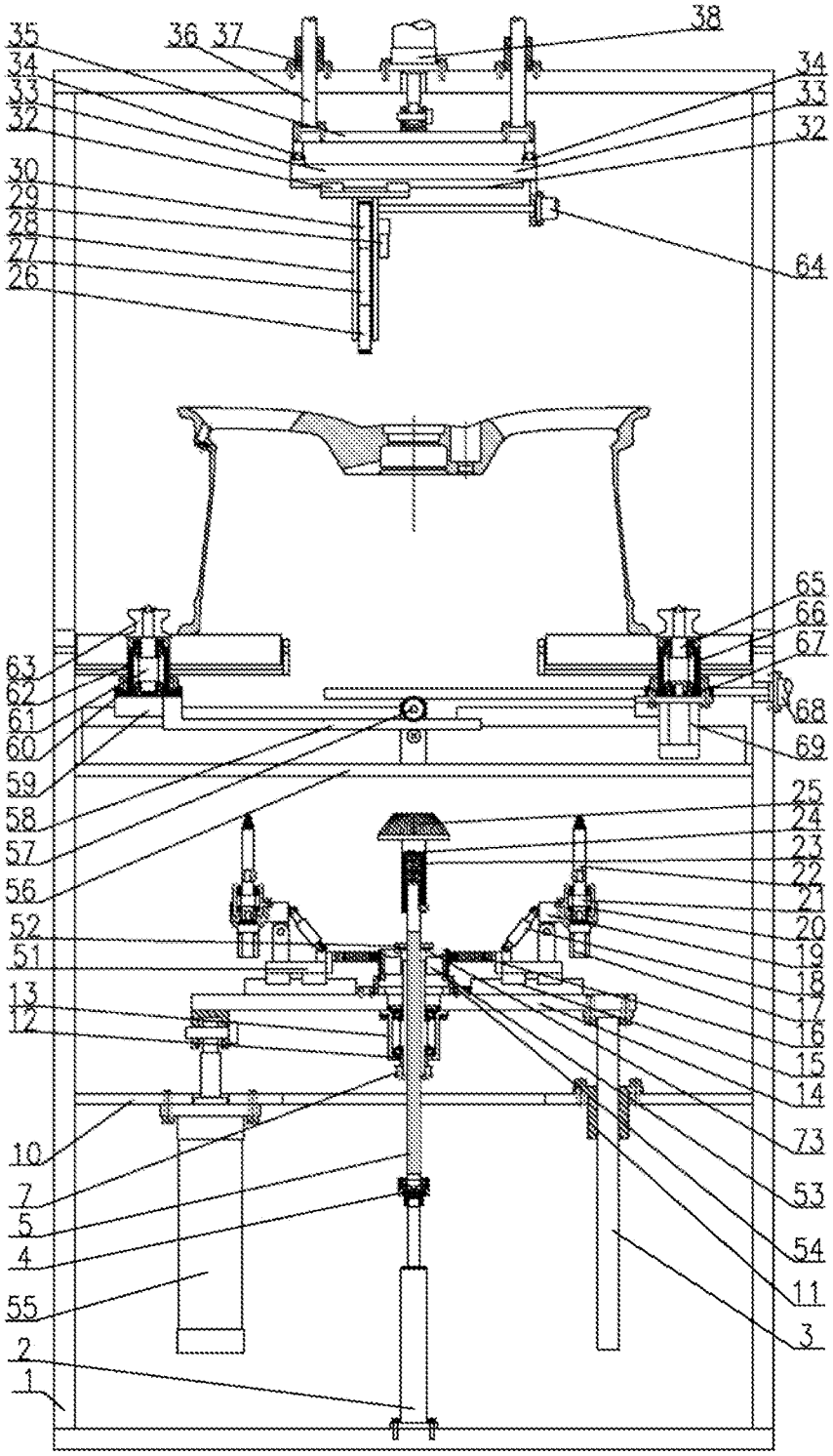
FIG. 2 is a left view of the wheel back cavity groove processing equipment of the present application.
Figure 3:
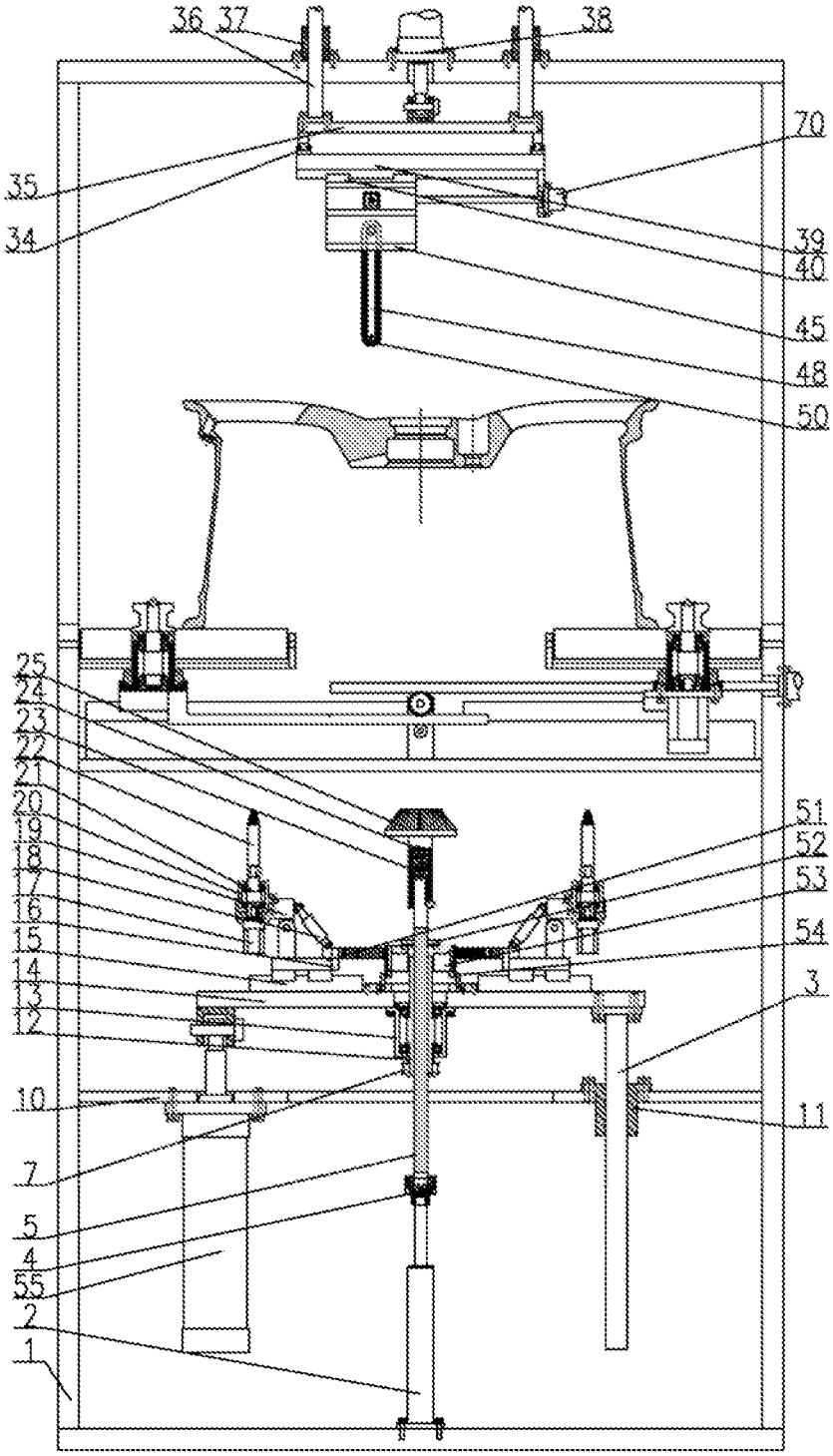
FIG. 3 is a right view of the wheel back cavity groove processing equipment of the present application.

In which, 1—frame, 2—first cylinder, 3—lower guide post, 4—rotary joint, 5—spline shaft, 6—first servo motor, 7—first belt pulley, 8—first synchronous belt, 9—second belt pulley, 10—lower fixed plate, 11—lower guide sleeve, 12—spline sleeve, 13—first bearing seat, 14—lower lifting plate, 15—first guide rail, 16—first rack, 17—second servo motor, 18—first servo electric cylinder, 19—turnover plate, 20—second bearing seat, 21—first shaft, 22—small grinding head, 23—spring, 24—sliding sleeve, 25—conical grinding head, 26—third belt pulley, 27—first annular belt brush, 28—first fixed rack, 29—third servo motor, 30—fourth belt pulley, 31—second servo electric cylinder, 32—second guide rail, 33—first sliding plate, 34—third guide rail, 35—upper lifting plate, 36—upper guide post, 37—upper guide sleeve, 38—second cylinder, 39—second sliding plate, 40—fourth guide rail, 41—third servo electric cylinder, 42—fourth servo motor, 43—fifth belt pulley, 44—second synchronous belt, 45—second fixed rack, 46—sixth belt pulley, 47—seventh belt pulley, 48—third fixed rack, 49—eight belt pulley, 50—second annular belt brush, 51—sliding rack, 52—deflector rod, 53—first gear, 54—swivel, 55—third cylinder, 56—upper fixed plate, 57—second gear, 58—second rack, 59—fifth guide rail, 60—left sliding plate, 61—left shaft, 62—left bearing seat, 63—V-shaped roller, 64—fourth servo electric cylinder, 65—right shaft, 66—right bearing seat, 67—right sliding plate, 68—fourth cylinder, 69—fifth servo motor, 70—fifth servo electric cylinder, 71—transition flange, 72—middle division plate, 73—groove, 74—bolt hole.

DETAILED DESCRIPTION OF THE INVENTION

Specific details and working conditions of equipment provided by the present application will be described below in combination with the accompanying drawings.

The equipment includes a frame 1, a first cylinder 2, lower guide posts 3, a rotary joint 4, a spline shaft 5, a first servo motor 6, a first belt pulley 7, a first synchronous belt 8, a second belt pulley 9, a lower fixed plate 10, lower guide sleeves 11, a spline sleeve 12, a first bearing seat 13, a lower lifting plate 14, first guide rails 15, first racks 16, second servo motors 17, first servo electric cylinders 18, turnover plates 19, second bearing seats 20, first shafts 21, small grinding heads 22, a spring 23, a sliding sleeve 24, a conical grinding head 25, a third belt pulley 26, a first annular belt brush 27, a first fixed rack 28, a third servo motor 29, a fourth belt pulley 30, a second servo electric cylinder 31, a second guide rail 32, a first sliding plate 33, a third guide rail 34, an upper lifting plate 35, upper guide posts 36, upper guide sleeves 37, second cylinders 38, a second sliding plate 39, a fourth guide rail 40, a third servo electric cylinder 41, a fourth servo motor 42, a fifth belt pulley 43, a second synchronous belt 44, a second fixed rack 45, a sixth belt pulley 46, a seventh belt pulley 47, a third fixed rack 48, an eighth belt pulley 49, a second annular belt brush 50, sliding racks 51, a deflector rod 52, a first gear 53, a swivel 54, third cylinders 55, an upper fixed plate 56, a second gear 57, second racks 58, a fifth guide rail 59, a left sliding plate 60, left shafts 61, left bearing seats 62, V-shaped rollers 63, a fourth servo electric cylinder 64, right shafts 65, right bearing seats 66, a right sliding plate 67, a fourth cylinder 68, a fifth servo motor 69 and a fifth servo electric cylinder 70.

A lower lifting system includes: the two third cylinders 55 and the four lower guide sleeves 11 are all fixed on the lower fixed plate 10, and the four lower guide posts 3 matched with the lower guide sleeves 11 are fixed below the lower lifting plate 14; and the output ends of the third cylinders 55 are articulated with the lower part of the lower lifting plate 14.

A central brush system includes: the first bearing seat 13 is fixed below the lower lifting plate 14; the spline sleeve 12 is mounted inside the first bearing seat 13 via a bearing; the spline shaft 5 is matched with the spline sleeve 12; the first cylinder 2 is fixed at the bottom of the frame 1, and the rotary joint 4 is fixed at the output end of the first cylinder 2; the upper part of the rotary joint 4 is connected with the lower part of the spline shaft 5; the first belt pulley 7 is fixed below the spline sleeve 12; the first servo motor 6 is fixed below the lower lifting plate 14 via a transition flange 71; the second belt pulley 9 is fixed at the output end of the first servo motor 6; the first belt pulley 7 is connected with the second belt pulley 9 via the synchronous belt 8; the spline shaft 5 is matched with the first bearing seat 13; the deflector rod 52 is fixed above the spline shaft 5; the spring 23 is mounted inside the sliding sleeve 24, and reaches the top of the spline shaft 5; and the conical grinding head 25 is fixed at the top of the sliding sleeve 24.

A groove brush system includes: the sliding rack 51 is mounted above the lower lifting plate 14 via the first guide rail 15; the first rack 16 is fixed on the sliding rack 51, and engaged with the first gear 53; the upper part of the first gear 53 is provided with a groove 73 matched with the deflector rod 52, and the lower part is mounted above the lower lifting plate 14 via the swivel 54; the second bearing seat 20 is mounted above the turnover plate 19; the first shaft 21 is mounted inside the second bearing seat 20 via a bearing; the small grinding head 22 is fixed above the first shaft 21; the second servo motor 17 is fixed below the turnover plate 19, and the output end thereof is connected with the lower part of the first shaft 21; the lower part of the turnover plate 19 is articulated with the upper part of the sliding rack 51; the lower part of the first servo electric cylinder 18 is articulated with the upper part of the sliding rack 51, and the output end thereof is articulated with the turnover plate 19; this equipment includes a plurality of sets of groove brush systems, which are uniformly distributed around the center line of the first gear 53 and correspond to bolt holes in number.

A synchronous clamping and rotating system includes: the second gear 57 is fixed above the upper fixed plate 56; the left sliding plate 60 is mounted above the upper fixed plate 56 via the fifth guide rail 59; the second rack 58 is fixed below the left sliding plate 60, and the two left bearing seats 62 are fixed above the left sliding plate 60; the two left shafts 61 are mounted inside the left bearing seats 62 via bearings; a V-shaped roller 63 is respectively mounted above the two left shafts 61; the right sliding plate 67 is mounted above the upper fixed plate 56 via the fifth guide rail 59; a second rack 58 is fixed below the right sliding plate 67, and the two right bearing seats 66 are fixed above the right sliding plate 67; the second rack 58 below the left sliding plate 60 and the second rack 58 below the right sliding plate 67 are simultaneously engaged with the second gear 57; the two right shafts 65 are mounted inside the right bearing seats 66 via bearings; a V-shaped roller 63 is respectively mounted above the two right shafts 65; the fifth servo motor 69 is fixed below the right sliding plate 67, and the output end thereof is connected with the lower end of one right shaft 65; the fourth cylinder 68 is fixed on the right of the frame 1, and the output end thereof is connected with the right sliding plate 67.

A left brush system includes: the third belt pulley 26 is mounted below the first fixed rack 28; the fourth belt pulley 30 is mounted above the first fixed rack 28; the third servo motor 29 is mounted on the side of the first fixed rack 28, and the output end thereof is connected with a shaft of the fourth belt pulley 30; the first annular belt brush 27 is simultaneously connected with the third belt pulley 26 and the fourth belt pulley 30; the top of the first fixed rack 28 is mounted below the first sliding plate 33 via the second guide rail 32; the first sliding plate 33 is mounted below the upper lifting plate 35 via the third guide rail 34; the second servo electric cylinder 31 is fixed on the left side of the upper lifting plate 35, and the output end thereof is connected with the first sliding plate 33; the fourth servo electric cylinder 64 is fixed at one end of the first sliding plate 33, and the output end thereof is connected with the first fixed rack 28.

A right brush system includes: the eight belt pulley 49 is mounted below the third fixed rack 48; the fixed rack 48 is fixed below the second fixed rack 45; the sixth belt pulley 46 is mounted on the right side of the seventh belt pulley 47, and mounted below the second fixed rack 45; the fourth servo motor 42 is fixed above a middle division plate 72 of the second fixed rack 45, and the fifth belt pulley 43 is fixed at the output end of the fourth servo motor 42; the fifth belt pulley 43 is connected with the sixth belt pulley 46 via the second synchronous belt 44; the seventh belt pulley 47 is connected with the eight belt pulley 49 via the second annular belt brush 50; the top of the second fixed rack 45 is mounted below the second sliding plate 39 via the fourth guide rail 40; the top of the second sliding plate 39 is mounted below the upper lifting plate 35 via the third guide rail 34; the third servo electric cylinder 41 is fixed on the right side of the upper lifting plate 35, and the output end thereof is connected with the second sliding plate 39; the fifth servo electric cylinder 70 is fixed at one end of the second sliding plate 39, and the output end thereof is connected with the second fixed rack.

An upper lifting system includes: the four upper guide posts 36 are fixed above the upper lifting plate 35; the four upper guide sleeves 37 matched with the upper guide posts 36 are fixed at the top of the frame 1; the two second cylinders 38 are also fixed at the top of the frame 1, and the output ends thereof are articulated with the upper part of the upper lifting plate 35.

In the working process, the fourth cylinder 68 drives the four V-shaped rollers 63 via the second gear 57 and the second racks 58 to synchronously clamp a wheel; the first servo motor 6 drives the spline sleeve 12 and the spline shaft 5 via the first belt pulley 7, the second belt pulley 9 and the synchronous belt 8 to rotate; the spline shaft 5 drives the conical grinding head 25 via the sliding sleeve 24 to rotate; the spring 23 keeps the conical grinding head 25 in a floating state; the second servo motors 17 drive the small grinding heads 22 via the first shafts 21 to rotate; the first servo electric cylinders 18 adjust the angles of the small grinding heads 22 in the groove brush systems via the turnover plates 19, so that the small grinding heads 22 are all in a vertical state; the first cylinder 2 drives the deflector rod 52 on the spline shaft 5 via the rotary joint 4 to decline, so that the deflector rod 52 is matched with the groove above the first gear 53; the first servo motor 6 drives the spline shaft 5 via the first synchronous belt 8 to rotate again, and simultaneously drives the first gear 53 to rotate; the first gear 53 can adjust the position of each small grinding head 22 via the first rack 16, so that the axis of the small grinding head 22 is on the pitch circle of each bolt hole of the wheel; the fifth servo motor 69 drives the clamped wheel to rotate, so that the axis of each bolt hole of the wheel is just coaxial with the axis of each small grinding head 22; the third cylinders 55 drive the small grinding heads 22 and the conical grinding head 25 via the lower guide posts 3 to ascend, to remove burrs thereon when they contact the bolt holes and the center hole of the wheel; after removal, the position of each small grinding head 22 is continuously adjusted via the first gear 53 and the first rack 16 to the edge of the wheel back cavity, and at the same time, the angle of each small grinding head 22 is adjusted via the first servo electric cylinder 18 to contact a groove at the edge of the wheel back cavity; the fifth servo motor 69 drives the wheel via the right shafts 65 to rotate, and burrs at the grooves can be removed; the third servo motor 29 drives the fourth belt pulley 30 to rotate, and the first annular belt brush 27 can rotate via the third belt pulley 26; the second servo electric cylinder 31 can drive the first annular belt brush 27 via the third guide rail 34 to move left and right; the fourth servo motor 64 can drive the first annular belt brush 27 via the second guide rail 32 to move front and back; the second cylinders 38 can drive the first annular belt brush 27 via the upper guide posts 36 to move up and down; burrs at the transverse corners of spokes can be removed via rotation of the first annular belt brush 27 and movement thereof in three directions; the fourth servo motor 42 drives the seventh belt pulley 47 via the fifth belt pulley 43, the sixth belt pulley 46 and the second synchronous belt 44 to rotate, and can drive the second annular belt brush 50 via the eight belt pulley 47 to rotate; the third servo electric cylinder 41 can drive the second annular belt brush 50 via the third guide rail 34 to move left and right; the fifth servo electric cylinder 70 can drive the second annular belt brush 50 via the fourth guide rail 40 to move front and back; the second cylinders 38 can drive the second annular belt brush 50 via the upper guide posts 36 to move up and down; and burrs at the edges of the spokes can be removed via rotation of the second annular belt brush 50 and movement thereof in three directions.

The foregoing descriptions of specific exemplary embodiments of the present application have been presented for purposes of illustration and description. They are not intended to be exhaustive or to limit the application to the precise forms disclosed, and obviously many modifications and variations are possible in light of the above teachings. The exemplary embodiments were chosen and described in order to explain certain principles of the application and their practical application, to thereby enable others skilled in the art to make and utilize various exemplary embodiments of the present application, as well as various alternatives and modifications thereof. It is intended that the scope of the application be defined by the Claims appended hereto and their equivalents.

What is claimed is:

1. A wheel back cavity groove processing equipment, comprising a frame, a first cylinder, four lower guide posts, a rotary joint, a spline shaft, a first servo motor, a first belt pulley, a first synchronous belt, a first bearing seat, a lower fixed plate, four lower guide sleeves, a spline sleeve, a first bearing seat, a lower lifting plate, first servo electric first racks, second servo motors, first servo electric cylinders, turnover plates, second bearing seats, first shafts, small grinding heads, a spring, a sliding sleeve, a conical grinding head, a third belt pulley, a first annular belt brush, a first fixed rack, a third servo motor, a fourth belt pulley, a second servo electric cylinder, a second guide rail, a first sliding plate, a third guide rail, an upper lifting plate, four upper guide posts, four upper guide sleeves, two second cylinders, a second sliding plate, a fourth guide rail, a third servo electric cylinder, a fourth servo motor, a fifth belt pulley, a second synchronous belt, a second fixed rack, a sixth belt pulley, a seventh belt pulley, a third fixed rack, an eight belt pulley, a second annular belt brush, sliding racks, a deflector rod, a first gear, a swivel, two third cylinders, an upper fixed plate, a second gear, two second racks, a fifth guide rail, a left sliding plate, two left shafts, two left bearing seats, four V-shaped rollers, a fourth servo electric cylinder, two right shafts, two right bearing seats, a right sliding plate, a fourth cylinder, a fifth servo motor and a fifth servo electric cylinder, wherein the wheel back cavity groove processing equipment comprising a lower lifting system, a central brush system, a groove brush system, a synchronous clamping and rotating system, a left brush system, a right brush system, and a upper lifting system, the lower lifting system is as follows: the two third cylinders and the four lower guide sleeves are all fixed on the lower fixed plate, and the four lower guide posts matched with the four lower guide sleeves are fixed below the lower lifting plate; and an output ends of the two third cylinders are articulated with a lower part of the lower lifting plate;

the central brush system is as follows: the first bearing seat is fixed below the lower lifting plate; the spline sleeve is mounted inside the first bearing seat via a bearing; the spline shaft is matched with the spline sleeve; the first cylinder is fixed at the bottom of the frame, and the rotary joint is fixed at the output end of the first cylinder; an upper part of the rotary joint is connected with a lower part of the spline shaft; the first belt pulley is fixed below the spline sleeve; the first servo motor is fixed below the lower lifting plate via a transition flange; the second belt pulley is fixed at the output end of the first servo motor; the first belt pulley is connected with the second belt pulley via the synchronous belt; the spline shaft is matched with the first bearing seat; the deflector rod is fixed above the spline shaft; the spring is mounted inside the sliding sleeve, and reaches a top of the spline shaft; and the conical grinding head is fixed at a top of the sliding sleeve;

the groove brush system is as follows: each of the sliding racks is mounted above the lower lifting plate via one of the first guide rails; each of the first racks is fixed on one of the sliding racks, and engaged with the first gear; an upper part of the first gear is provided with a groove matched with the deflector rod, and a lower part of the first gear is mounted above the lower lifting plate via the swivel; each of the second bearing seats is mounted above one of the turnover plates; each of the first shafts is mounted inside one of the second bearing seats via bearings; each of the small grinding heads is fixed above one of the first shafts; each of the second servo motors is fixed below one of turnover plates, and an output end of each of the second servo motors is connected with the lower part of one of the first shafts; lower part of each of the turnover plates is articulated with upper part of one of the sliding racks; lower part of each of the first servo electric cylinders is articulated with upper part of one of the sliding racks, and an output end of each of the first servo electric cylinders is articulated with one of the turnover plates; the wheel back cavity groove equipment comprises a plurality of sets of groove brush systems, which are uniformly distributed around a center line of the first gear and correspond to bolt holes on the wheel in number;

the synchronous clamping and rotating system is as follows: the second gear is fixed above the upper fixed plate; the left sliding plate is mounted above the upper fixed plate via the fifth guide rail; one of the two second racks is fixed below the left sliding plate, and the two left bearing seats are fixed above the left sliding plate; the two left shafts are mounted inside the two left bearing seats via bearings; two of the four V-shaped rollers are respectively mounted above the two left shafts; the right sliding plate is mounted above the upper fixed plate via the fifth guide rail; the other of the two second racks is fixed below the right sliding plate, and the two right bearing seats are fixed above the right sliding plate; the second rack below the left sliding plate and the second rack below the right sliding plate are simultaneously engaged with the second gear; the two right shafts are mounted inside the two right bearing seats via bearings; the other two of the four V-shaped rollers are respectively mounted above the two right shafts; the fifth servo motor is fixed below the right sliding plate, and the output end of the fifth servo motor is connected with the lower end of one of the two right shafts; fourth cylinder is fixed on the right of the frame, and an output end of the fourth cylinder is connected with the right sliding plate;

the left brush system is as follows: the third belt pulley is mounted below the first fixed rack; the fourth belt pulley is mounted above the first fixed rack; the third servo motor is mounted on side of the first fixed rack, and an output end of the third servo motor is connected with a shaft of the fourth belt pulley; the first annular belt brush is simultaneously connected with the third belt pulley and the fourth belt pulley; a top of the first fixed rack is mounted below the first sliding plate via the second guide rail; the first sliding plate is mounted below the upper lifting plate via the third guide rail; the second servo electric cylinder is fixed on left side of the upper lifting plate, and an output end of the second servo electric cylinder is connected with the first sliding plate; the fourth servo electric cylinder is fixed at one end of the first sliding plate, and an output end of the fourth servo electric cylinder is connected with the first fixed rack;

the right brush system is as follows: the eighth belt pulley is mounted below the third fixed rack; the third fixed rack is fixed below the second fixed rack; the sixth belt pulley is mounted on the right side of the seventh belt pulley, and mounted below the second fixed rack; the fourth servo motor is fixed above a middle division plate of the second fixed rack, and the fifth belt pulley is fixed at an output end of the fourth servo motor; the fifth belt pulley is connected with the sixth belt pulley via the second synchronous belt; the seventh belt pulley is connected with the eighth belt pulley via the second annular belt brush; a top of the second fixed rack is mounted below the second sliding plate via the fourth guide rail; a top of the second sliding plate is mounted below the upper lifting plate via the third guide rail; the third servo electric cylinder is fixed on right side of the upper lifting plate, and an output end of the third servo electric cylinder is connected with the second sliding plate; the fifth servo electric cylinder is fixed at one end of the second sliding plate, and an output end of the fifth servo electric cylinder is connected with the second fixed rack;

a the upper lifting system is as follows: the four upper guide posts are fixed above the upper lifting plate; the four upper guide sleeves matched with the four upper guide posts are fixed at a top of the frame; the two second cylinders are also fixed at a top of the frame, and output ends of the two second cylinders are articulated with upper part of the upper lifting plate;

in the working process, the fourth cylinder drives the four V-shaped rollers via the second gear and the second racks to synchronously clamp a wheel; the first servo motor drives the spline sleeve and the spline shaft via the first belt pulley, the second belt pulley and the synchronous belt to rotate, the spline shaft drives the conical grinding head via the sliding sleeve to rotate, the spring keeps the conical grinding head in a floating state; the second servo motors drive the small grinding heads via the first shafts to rotate; the first servo electric cylinders adjust the angles of the small grinding heads in the groove brush systems via the turnover plates, so that the small grinding heads are all in a vertical state; the first cylinder drives the deflector rod on the spline shaft via the rotary joint to decline, so that the deflector rod is matched with the groove above the first gear; the first servo motor drives the spline shaft via the first synchronous belt to rotate again, and simultaneously drives the first gear to rotate; the first gear can adjust the position of each small grinding head via the first rack, so that the axis of the small grinding head is on the pitch circle of each bolt hole of the wheel; the fifth servo motor drives the clamped wheel to rotate, so that the axis of each bold hole of the wheel is just coaxial with the axis of each small grinding head; the third cylinders drive the small grinding heads and the conical grinding head via the lower guide posts to ascend to remove burrs thereon when they contact the bolt holes and the center hole of the wheel; after removal, the position of each small grinding head is continuously adjusted via the first gear and the first rack to the edge of the wheel back cavity, and at the same time, the angle of each small grinding head is adjusted via the first servo electric cylinder to contact a groove at the edge of the wheel back cavity; the fifth servo motor drives the wheel via the right shafts to rotate, and burrs at the grooves can be removed; the third servo motor drives the fourth belt pulley to rotate, and the first annular belt brush can rotate via the third belt pulley, the second servo electric cylinder can drive the first annular belt brush via the third guide rail to move left and right; the fourth servo motor can drive the first annular belt brush via the second guide rail to move front and back; the second cylinders can drive the first annular belt brush via the upper guide posts to move up and down; burrs at the transverse corners of spokes can be removed via rotation of the first annular belt brush and movement thereof in three directions; the fourth servo motor drives the seventh belt pulley via the fifth belt pulley, the sixth belt pulley and the second synchronous belt to rotate, and can drive the second annular belt brush via the eighth belt pulley to rotate, the third servo electric cylinder can drive the second annular belt brush via the third guide rail to move left and right; the fifth servo electric cylinder can drive the second annular belt brush via the fourth guide rail to move front and back; the second cylinders can drive the second annular belt brush via the upper guide posts to move up and down; and burrs at the edges of the spokes can be removed via rotation of the second annular belt brush and movement thereof in three directions.

* * * * *